US009283779B2

(12) United States Patent
Hobo et al.

(10) Patent No.: US 9,283,779 B2
(45) Date of Patent: Mar. 15, 2016

(54) CONVEYOR DEVICE AND INKJET RECORDING APPARATUS

(71) Applicant: KYOCERA Document Solutions Inc., Osaka-shi (JP)

(72) Inventors: Jumpei Hobo, Osaka (JP); Takeshi Watanabe, Osaka (JP); Hidenori Takenaka, Osaka (JP); Tomohisa Soda, Osaka (JP); Masami Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/715,024

(22) Filed: May 18, 2015

(65) Prior Publication Data

US 2015/0336406 A1 Nov. 26, 2015

(30) Foreign Application Priority Data

May 20, 2014 (JP) ..... 2014-104211

(51) Int. Cl.
*B41J 2/01* (2006.01)
*B41J 11/00* (2006.01)
*B41J 13/10* (2006.01)

(52) U.S. Cl.
CPC ..... *B41J 11/0085* (2013.01); *B41J 11/007* (2013.01); *B41J 13/103* (2013.01)

(58) Field of Classification Search
CPC .... B41J 11/007; B41J 11/0085; B41J 13/103; B41J 13/0009
USPC ..... 347/16, 101, 104
See application file for complete search history.

(56) References Cited

U.S. PATENT DOCUMENTS 8,182,081 B2 * 5/2012 Yamamoto et al. ..... 347/104

FOREIGN PATENT DOCUMENTS

JP 2011-183746 A 9/2011

* cited by examiner

*Primary Examiner* — An Do
(74) *Attorney, Agent, or Firm* — Studebaker & Brackett PC

(57) ABSTRACT

A conveyor device includes a feed member, a conveyor belt, and a suction section. The feed member feeds a recording medium while in contact with a part of the recording medium. The conveyor belt conveys the recording medium having been conveyed by the feed member. The suction section sucks the recording medium onto the conveyor belt. The conveyor belt includes a first region that is to receive the part of the recording medium and a second region adjacent to the first region. The conveyor belt has a plurality of suction holes in communication with the suction section. The suction holes have a lower opening ratio in the first region than in the second region.

9 Claims, 13 Drawing Sheets

CONVEYOR DEVICE AND INKJET RECORDING APPARATUS

INCORPORATION BY REFERENCE

The present application claims priority under 35 U.S.C. §119 to Japanese Patent Application No. 2014-104211, filed May 20, 2014. The contents of this application are incorporated herein by reference in their entirety.

BACKGROUND

The present disclosure relates to conveyor devices and inkjet recording apparatuses.

An inkjet recording apparatus conveys a sheet of paper as a recording medium such as copy paper using a conveyor belt and a feed member included therein. The feed member includes a paper feed roller, a conveyance roller, a sheet guide, etc. Recording heads forms an image on a sheet by ejecting ink droplets toward the sheet conveyed. In order to reduce degradation of image quality that may be caused due to sheet flexure or sheet lift up from the conveyor belt in the course of sheet conveyance, an inkjet recording apparatus has been developed that includes a conveyor belt through which suction holes are perforated and a suction section that sucks on a sheet through the conveyor belt.

In an inkjet recording apparatus having such a configuration, paper dust is generated by contact between a sheet and the feed member in the course of conveyance to be attached to the sheet. When such a sheet to which paper dust is attached is conveyed along a conveyance path to the conveyor belt, air flow through the conveyor belt may separate and stir up the paper dust from the sheet to cause the paper dust to be attached to nozzles.

In order to reduce separation and stirring up of paper dust from a sheet over the conveyor belt and attachment thereof to the nozzles, a certain liquid ejection device is provided that causes paper dust attached to a sheet to separate from the sheet by blowing air to the sheet in an area upstream of the nozzles in the conveyance path.

SUMMARY

A conveyor device according to the present disclosure includes a feed member, a conveyance belt, and a suction section. The feed member feeds a recording medium while in contact with a part of the recording medium. The conveyor belt conveys the recording medium having been fed by the feed member. The suction section sucks the recording medium onto the conveyance belt. The conveyor belt includes a first region that is to receive the part of the recording medium and a second region adjacent to the first region. The conveyor belt has a plurality of suction holes in communication with the suction section. The suction holes have a lower opening ratio in the first region lower than in the second region.

An inkjet recording apparatus according to the present disclosure includes the above conveyor device and an inkjet head. The inkjet head is located opposite to the conveyor device.

DETAILED DESCRIPTION

Figure 1:
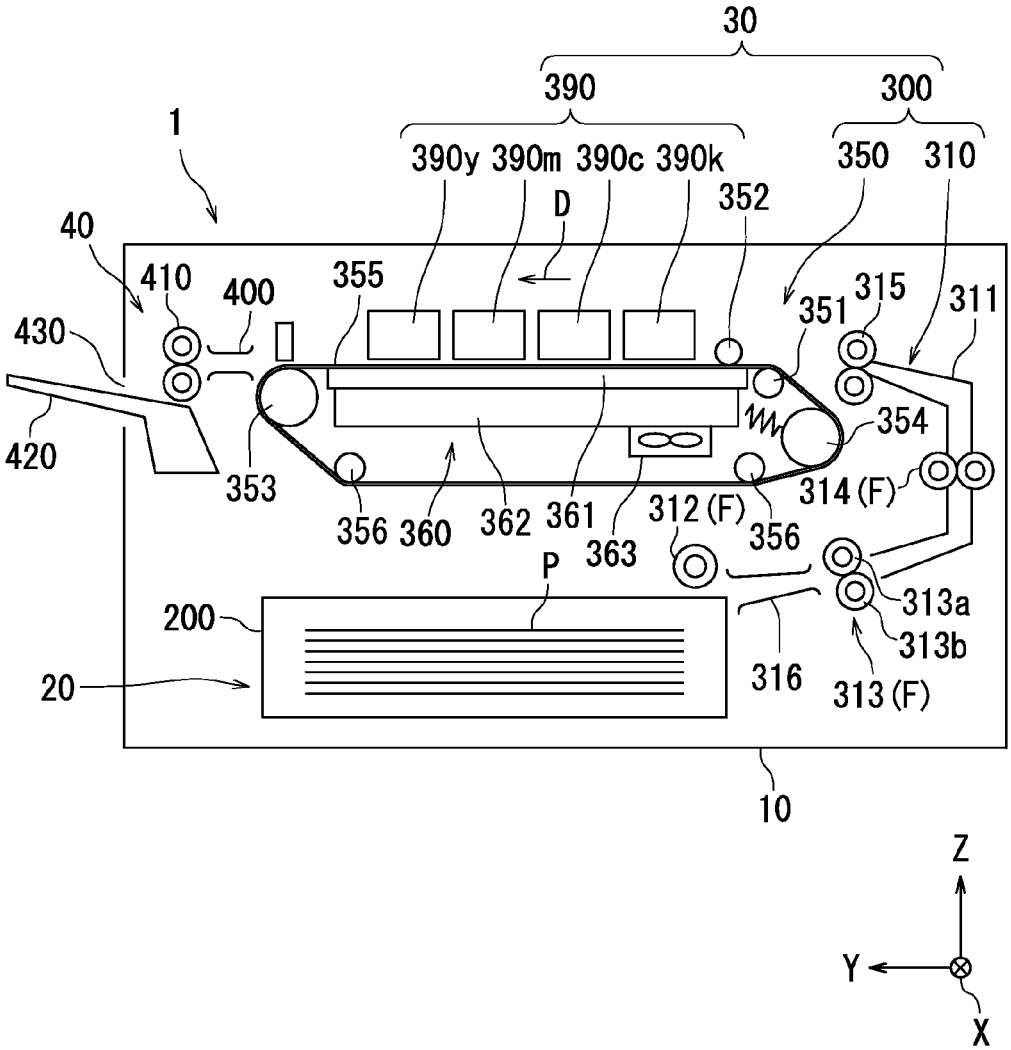
FIG. 1 illustrates a configuration of an inkjet recording apparatus including a conveyor device.

Embodiments of an conveyor device and an inkjet recording apparatus according to the present disclosure will be described below with reference to the accompanying drawings. Note that in the figures of the accompanying drawings, the like reference numerals refer to same or corresponding elements, and description thereof is not repeated.

(First Embodiment: Basic Principle)

Figure 2A:
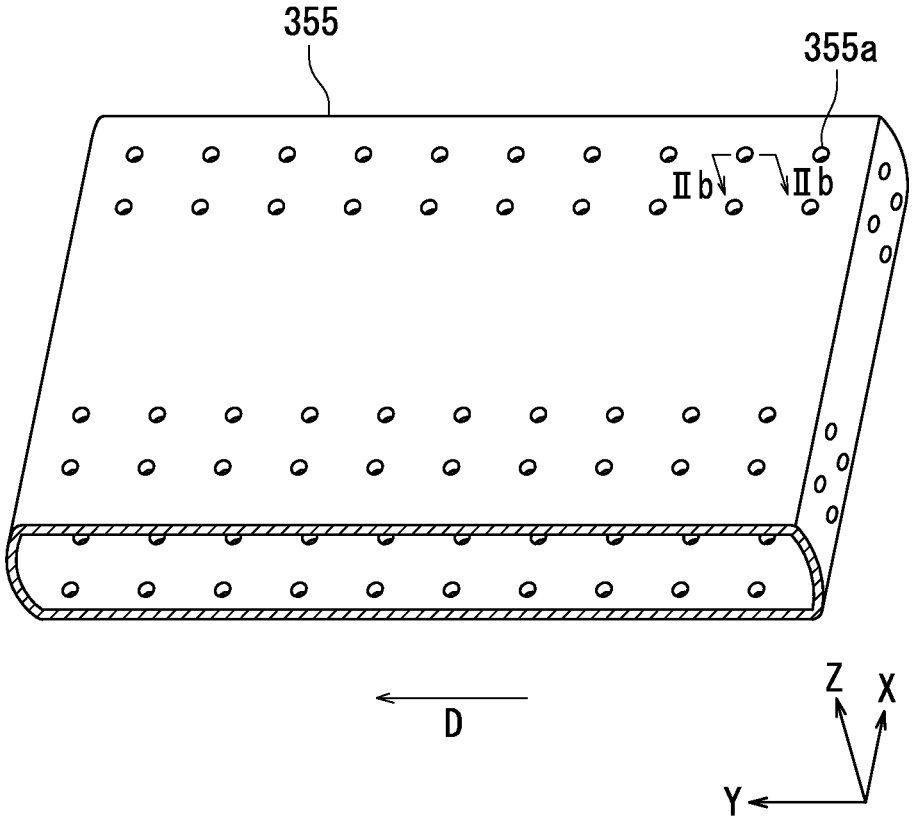
FIG. 2A is a perspective view illustrating a conveyor belt.

The basic principle of a conveyor device according to a first embodiment of the present disclosure will be described with reference to FIGS. 1 and 2A. FIG. 1 illustrates a configuration of an inkjet recording apparatus 1. FIG. 2A is a perspective view illustrating a conveyor belt 355.

The inkjet recording apparatus 1 includes a conveyor device 300 and recording heads 390. The conveyor device 300 is located opposite to the recording heads 390.

The conveyor device 300 includes an endless conveyor belt 355 and a suction section 360. The conveyor belt 355 conveys a recording medium P. The suction section 360 sucks on the recording medium P through the conveyor belt 355. The suction section 360 includes a guide member 361. The guide member 361 supports the recording medium P with the conveyor belt 355 therebetween.

[Configuration of Inkjet Recording Apparatus 1]

With reference to FIG. 1, the inkjet recording apparatus 1 will be described next. The inkjet recording apparatus 1 includes an apparatus housing 10, a paper feed section 20 located in a lower section of the apparatus housing 10, an image forming section 30 using an inkjet recording method, and a paper ejecting section 40.

The paper feed section 20 includes a paper feed cassette 200. The paper feed cassette 200 is freely detachable from the apparatus housing 10. The paper feed cassette 200 contains a plurality of recording media P in a stacked state. The recording media P may be paper like plain paper, recycled paper, thin paper, or thick paper, for example.

The image forming section 30 includes the conveyor device 300 and the recording heads 390. The conveyor device 300 includes a first paper conveyance section 310 and a second paper conveyance section 350 located opposite to the recording heads 390. The second paper conveyance section 350 is located between the first paper conveyance section 310 and the paper ejecting section 40. Note that the image forming section 30 may also include a drying device (not illustrated). The drying device dries ink droplet having ejected on a recording medium P.

The first paper conveyance section 310 has a paper conveyance path 311 that is roughly C-shaped. The first paper conveyance section 310 includes a paper feed roller 312, a first pair of conveyance rollers 313, a second pair of conveyance rollers 314, a pair of registration roller, and guide plates 316. The paper feed roller 312 is located above one end of the paper feed cassette 200. The first pair of conveyance rollers 313 is located at an input end of the paper conveyance path 311. The second pair of conveyance rollers 314 is located midway in the paper conveyance path 311. The pair of registration rollers 315 is located at an output end of the paper conveyance path 311.

The guide plates 316 are located between the paper feed roller 312 and the first pair of conveyance rollers 313. The paper feed roller 312 picks up the recording media P contained in the paper feed cassette 200 one at a time. The guide plates 316 guide the recording medium P picked up by the paper feed roller 312 to the first pair of conveyance rollers 313.

Referring to FIG. 1, the X axis is parallel to a direction perpendicular to a conveyance direction D of a recording medium P. The Y axis is parallel to the conveyance direction D of a recording medium P when the recording medium is loaded above the guide member 361. The Z axis is parallel to a direction perpendicular to the guide member 361. In the following description, the Z axis is a vertical direction. The X, Y, and Z axes intersect one another orthogonally.

The first pair of conveyance rollers 313 sandwiches the recording medium P guided by the guide plates 316 and feeds it to the paper conveyance path 311. A specific process is as follows. The first pair of conveyance rollers 313 includes a feed roller 313*a* and a retard roller 313*b*. The feed roller 313*a* and the retard roller 313*b* are located opposite to and in press contact with each other. The feed roller 313*a* rotates to feed the recording medium P in the conveyance direction D. Upon receiving a single recording medium P, the retard roller 313*b* follows the rotation of the feed roller 313*a* to be rotated. By contrast, upon receiving a plurality of recording media P in layers, the retard roller 313*b* rotates in a direction inverse to a direction in which the recording media P is fed, or stops for separating a recording medium P in contact with the feed roller 313*a* from the other recording medium or media P. As a result, the single recording medium P can be fed by the feed roller 313*a*.

The second pair of conveyance rollers 314 sandwiches the recording medium P having been fed by the first pair of conveyance rollers 313 and conveys it to the pair of registration rollers 315. The pair of registration rollers 315 performs skew correction on the recording medium P that has abutted on and stops at the pair of registration rollers 315. The pair of registration rollers 315 then temporarily holds the recording medium P in order to synchronize conveyance of the recording medium P with a timing at which printing is to be performed on the recording medium P. The pair of registration rollers 315 subsequently feeds the recording medium P to the second paper conveyance section 350 in accordance with the timing of printing on the recording medium P.

The second paper conveyance section 350 includes a speed detection roller 351, a sheet holding roller 352, a drive roller 353, a tension roller 354, a pair of guide rollers 356, the endless conveyor belt 355, and a suction section 360. The conveyor belt 355 is wound around the speed detection roller 351, the drive roller 353, the tension roller 354, and the pair of guide rollers 356. In the present specification, a surface of the conveyor belt 355 on which a recording medium P is to be loaded is referred to as a conveyance surface and a surface thereof opposite to the conveyance surface is referred to as a conveyance reverse surface. The rotation axis of each of the rollers including the drive roller 353 is arranged in parallel to the X axis. The conveyor belt 355 has a plurality of suction holes. Each of the suction holes passes from the conveyance surface to the conveyance reverse surface through the conveyor belt 355.

The speed detection roller 351 is located upstream of the guide member 361 in terms of the conveyance direction D of the recording medium P. The speed detection roller 351 includes a pulse plate not illustrated. The speed detection roller 351 is rotated by being in contact with the conveyor belt 355 that circulates. The circulation speed of the conveyor belt 355 is detected by measuring the rotational speed of the pulse plate that is rotated solidly with the speed detection roller 351. The speed detection roller 351 reduces influence of meandering correction on the conveyor belt 355 under the recording heads 390.

The sheet holding roller 352 is located at an upstream end of the guide member 361 in terms of the conveyance direction D with the conveyor belt 355 therebetween. The sheet holding roller 352 conveys the recording medium P in the conveyance direction D while pressing the recording medium P against the conveyor belt 355 and the guide member 361. The sheet holding roller 352 reduces curling of the recording medium P so that the suction section 360 sucks on and holds of the recording medium P entirely uniformly. The configuration as above can allow the recording medium P to be held on the conveyor belt 355 in a secured manner. In order to reduce vibration of the sheet holding roller 352 that may be caused due to collision of the recording medium P with the sheet holding roller 352 at arrival of the recording medium P at the sheet holding roller 352, it is preferable that the moment of inertia of the sheet holding roller 352 is small and the sheet holding roller 352 is light. For example, the sheet holding roller 352 may be an aluminum hollow pipe or a hollow pipe with a plurality of ribs. In a configuration in which the surface layer of the sheet holding roller 352 is made from aluminum, the surface of the sheet holding roller 352 may be anodized in order to prevent abrasion. Being anodized herein means formation of an aluminum oxide film by electrolysis of aluminum as an anode in an acid treatment bath for electrochemical oxidation on the surface of the aluminum Note that anodization makes the sheet holding roller 352 electrically insulated. However, in a situation in which the sheet holding roller 352 should be conductive, the surface of the sheet holding roller 352 is not anodized.

The speed of the recording medium P conveyed by the pair of registration rollers 315 may differ from the speed thereof conveyed by the conveyor belt 355 in some situations. However, such difference can be reduced in a manner that the sheet holding roller 352 applies pressing force to the recording medium P on the conveyor belt 355 to cause the recording medium P to flex between the pair of registration rollers 315 and the sheet holding roller 352.

The drive roller 353 is spaced apart from the speed detection roller 351 in terms of the conveyance direction D of the recording medium P. The speed detection roller 351 and the drive roller 353 keep the conveyor belt 355 on the guide member 361 flat. The drive roller 353 is in close contact with the conveyor belt 355 by friction force. For example, in a configuration in which the conveyor belt 355 is made from a resinous material such as polyimide (PI), polyamidimide (PAI), polyvinylidene fluoride (PVDF), or polycarbonate (PC), a surface layer of the drive roller 353 is preferably made from a rubber material such as ethylene propylene diene (EPDM) rubber, polyurethane resin, or nitrile rubber (NBR). In a configuration in which the image forming section 30 forms an image on the recording medium P using an aqueous ink, EPDM rubber is preferably used as a material of the surface layer of the drive roller 353 in order to prevent swelling of the rubber material.

In a configuration in which the conveyor belt 355 is made from a rubber material such as EPDM, the surface layer of the drive roller 353 may be made from a metal. In a configuration in which the surface layer of the drive roller 353 is made from aluminum, the surface of the drive roller 353 may be anodized in order to prevent abrasion. Anodization makes the drive roller 353 electrically insulated. However, in a situation in which the drive roller 353 should be conductive, the surface of the drive roller 353 is not anodized. Note that in a configuration in which the drive roller 353 are electrically conducted to the conveyor belt 355, electric grounding of the conveyor belt 355 can prevent reduction in accuracy of ink trajectory. In the configuration as above, the rubber material forming the conveyor belt 355 is made conductive.

The drive roller 353 is driven to be rotated by a motor (not illustrated) to circulate the conveyor belt 355 in the anticlockwise direction. In a situation in which unevenness in circulation speed of the conveyor belt 355 occurs, correction of the unevenness may be performed on the conveyor belt 355. The correction of the unevenness means to correct unevenness of the speed of the conveyor belt 355 to keep the conveyor belt 355 circulating at a constant speed. In a configuration in which unevenness of speed of the conveyor belt 355 is corrected, the drive roller 353 preferably has a low moment of inertia and is light. For example, the drive roller 353 may be a hollow pipe such as an aluminum pipe or a hollow pipe with a plurality of ribs. By contrast, in a configuration in which unevenness of speed of the conveyor belt 355 is not corrected, the drive roller 353 is preferably heavy in order to stabilize rotation of the drive roller 353 through a flywheel effect. In the configuration as above, the drive roller 353 is made from a material such as solid metal.

The tension roller 354 is located at an upstream end of the guide member 361 in the interior of the conveyor belt 355. The tension roller 354 applies tensile force to the conveyor belt 355 in order to ensure that the conveyor belt from does not sag. By changing orientation of one of the end portions of the tension roller 354, meandering of the conveyor belt 355 can be corrected in a self-regulating manner.

The conveyor belt 355 conveys the recording medium P held on the conveyor belt 355. The conveyor belt 355 is preferably made from polyamidimide (PAI) or polyimide (PI), for example. Use of such a material can reduce unevenness in thickness of the conveyor belt 355. The pair of guide rollers 356 is located below the suction section 360.

The pair of guide roller 356 is secured in place such as to confine a space surrounded by the inner peripheral surface (conveyance reverse surface) of the conveyor belt 355. A guide roller 356 of the pair of guide rollers 356 that is closer to the drive roller 353 keeps the amount of winding of the conveyor belt 355 to the drive roller 353 constant. The other guide roller 356 that is closer to the tension roller 354 keeps the amount of winding of the conveyor belt 355 to the tension roller 354 constant for stable meandering correction on the conveyor belt 355.

The suction section 360 is located on the side of the conveyance reverse surface of the conveyor belt 355 such as to be opposite to the recording heads 390 with the conveyor belt 355 therebetween. The suction section 360 includes the guide member 361, an air flow chamber 362, and at least one sucking device 363.

The air flow chamber 362 is a hollow casing having an open top end. In other words, the upper portion of the air flow chamber 362 has an opening. The guide member 361 covers (blocks) the upper opening of the air flow chamber 362. The guide member 361 supports the recording medium P through the conveyor belt 355.

The sucking device 363 is disposed in communication with the air flow chamber 362 and draws air in the air flow chamber 362 to create negative pressure in the air flow chamber 362. As a result, the recording medium P is sucked toward the top of the air flow chamber 362 through the conveyor belt 355 and the guide member 361. It should be noted here that negative pressure refers to pressure lower than reference pressure. The reference pressure referred to in the present specification is atmospheric pressure. Negative pressure "$P_N$" is an absolute value of ($P_A$−$P_R$), wherein "$P_A$" represents the absolute pressure and "$P_R$" represents the reference pressure ($P_N$=|$P_A$−$P_R$|). The absolute pressure is pressure based on the absolute vacuum of 0. The air flow chamber 362 functions as a decompression chamber.

The paper ejecting section 40 includes a conveyance guide 400, a pair of ejection rollers 410, and an exit tray 420. The conveyance guide 400 is located downstream of the second paper conveyance section 350 in terms of the conveyance direction D of the recording medium P. The exit tray 420 is fixed to the apparatus housing 10 and protrudes outward from an exit port 430 formed in the apparatus housing 10.

The conveyance guide 400 guides the recording medium P being conveyed from the conveyor belt 355 to the pair of ejection rollers 410. The recording medium P that has passed through the conveyance guide 400 is conveyed by the pair of ejection rollers 410 to the exit port 430 and ejected onto the exit tray 420 through the exit port 430.

Figure 2B:
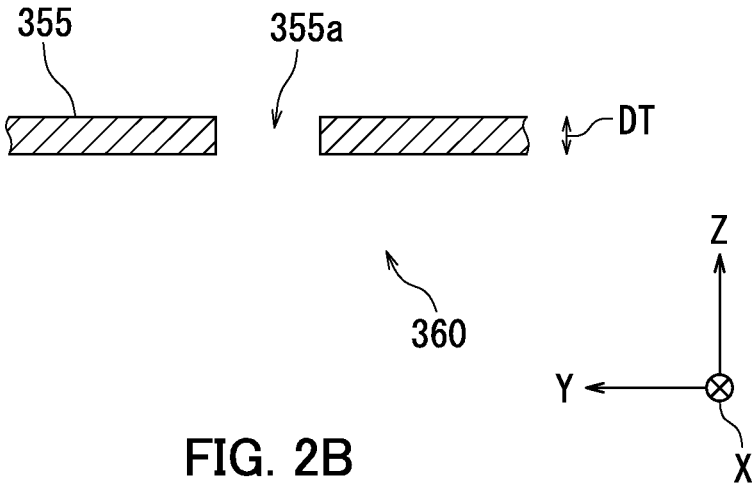
FIG. 2B is a cross sectional view taken along the line IIb-IIb in FIG. 2A.

The conveyor belt 355 will be described with reference to FIGS. 2A and 2B. FIG. 2B is a cross sectional view taken along the line IIb-IIb in FIG. 2A.

As illustrated in FIG. 2A, the conveyor belt 355 has a plurality of suction holes 355*a*. The conveyor belt 355 has a thickness of 100 μm, for example.

As illustrated in FIG. 2B, each of the suction holes 355*a* is in communication with the suction section 360. The suction hole 355*a* passes through the conveyor belt 355 in a thickness direction DT thereof. The opening of the suction hole 355*a* has a circular shape in plan. The suction hole 355*a* has a diameter of 2 mm. Note that the shape of the suction hole 355*a* in plan may be oval, square, or rectangular, for example.

Figure 3A:
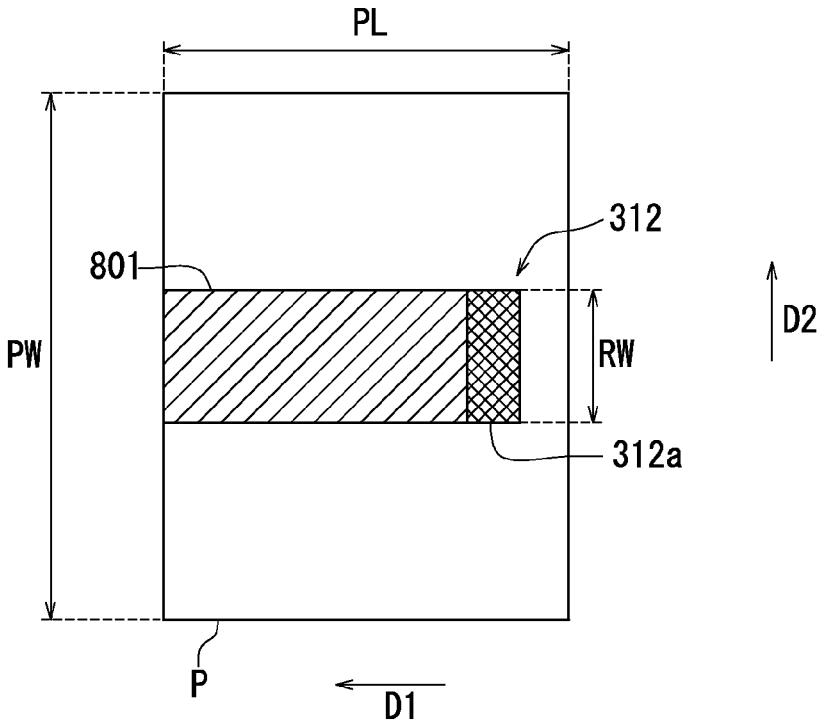
FIGS. 3A and 3B each illustrate a contact region of a recording medium.
Figure 3B:
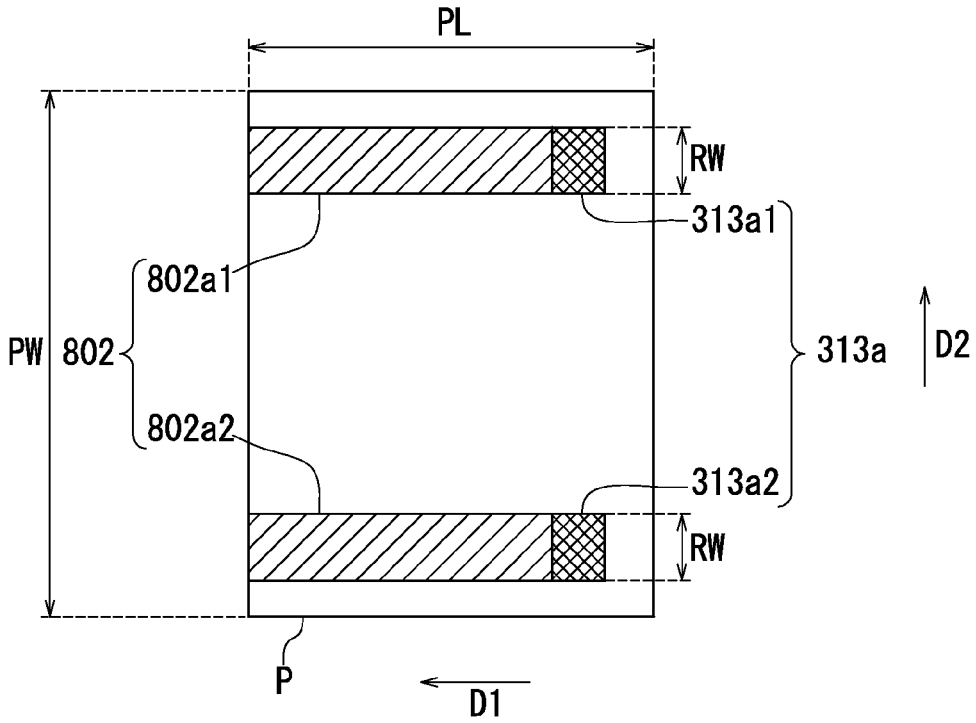

Referring to FIGS. 1, 3A, and 3B, the relationship between a part of the recording medium P and a feed member F will be described. Of the recording medium P, a surface on to which printing is performed in simplex printing will be referred to as a print surface, and the other surface will be referred to as a print reverse surface. FIGS. 3A and 3B each illustrate the recording medium P as viewed in the normal direction of the print surface. A direction in parallel to the print surface of the recording medium P and perpendicular to the conveyance direction D1 is referred to as a width direction D2. A width of the recording medium P is represented by PW. A length of the recording medium P is represented by PL.

The feed member F includes the first pair of conveyance rollers 313, the second pair of conveyance rollers 314, and the paper feed roller 312. The recording medium P comes in contact with the feed member F in conveyance of the recording medium P in the conveyance direction D1. A part of the recording medium P that comes in contact with the feed member F will be referred to as a contact region.

With reference to FIG. 3A, description will be made first about a situation in which the recording medium P comes in contact with the paper feed roller 312. As illustrated in FIG. 3A, the paper feed roller 312 includes one roller member 312*a*. The roller member 312*a* is located around the center in terms of the width PW of the recording medium P. The roller member 312*a* has a width RW that is narrower than the width PW of the recording medium P. The roller member 312*a* comes in contact with a part of the recording medium P when picking up the recording medium P from the paper feed cassette 200 and feeding it into the conveyance direction D1.

A region of the print surface of the recording medium P that comes in contact with the roller member 312*a* is referred to as a contact region 801. The contact region 801 illustrated in FIG. 3A is a region in the print surface of the recording medium P but may be a region in the print reverse surface thereof or each of them. The contact region 801 is a region of the recording medium P extending in the conveyance direction D1.

A situation in which the feed roller 313*a* is in contact with the recording medium P will be described with reference to FIG. 3B. As illustrated in FIG. 3B, the feed roller 313*a* includes roller members 313*a*1 and 313*a*2.

The roller member 313*a*1 comes in contact with a right end part of the recording medium P in terms of the conveyance direction D1. The roller member 313*a*2 comes in contact with a left end part of the recording medium P in terms of the conveyance direction D1. Each of the roller members 313*a*1 and 313*a*2 has a width RW that is narrower than the width PW of the recording medium P. Accordingly, the roller members 313*a*1 and 313*a*2 come in contact with a contact region 802 of the recording medium P when feeding the recording medium P in the conveyance direction D1.

The contact region 802 includes a contact region 802*a*1 and a contact region 802*a*2. The contact region 801*a*1 is a region of the print surface of the recording medium P that comes in contact with the roller member 313*a*1. The contact region 802*a*1 is a region in the print surface of the recording medium P but may be a region in the print reverse surface thereof or each of them. The contact region 802*a*2 is a region of the print surface of the recording medium P that comes in contact with the roller member 313*a*2. The contact region 802*a*2 is a region in the print surface of the recording medium P but may be a region in the print reverse surface thereof or each of them. The contact region 802 (contact regions 802*a*1 and 802*a*2) is a region of the recording medium P extending in terms of the conveyance direction D1.

Note that the paper feed roller 312 includes only one roller member in FIG. 3A but may include two or more roller members. Also, the feed roller 313*a* includes two roller members in FIG. 3B but may include one or three or more roller members. Note that the feed member F includes but not limited to the paper feed roller 312 and the feed roller 313*a* so long as such a member has a width that is narrower than the width PW of the recording medium P.

Figure 4:
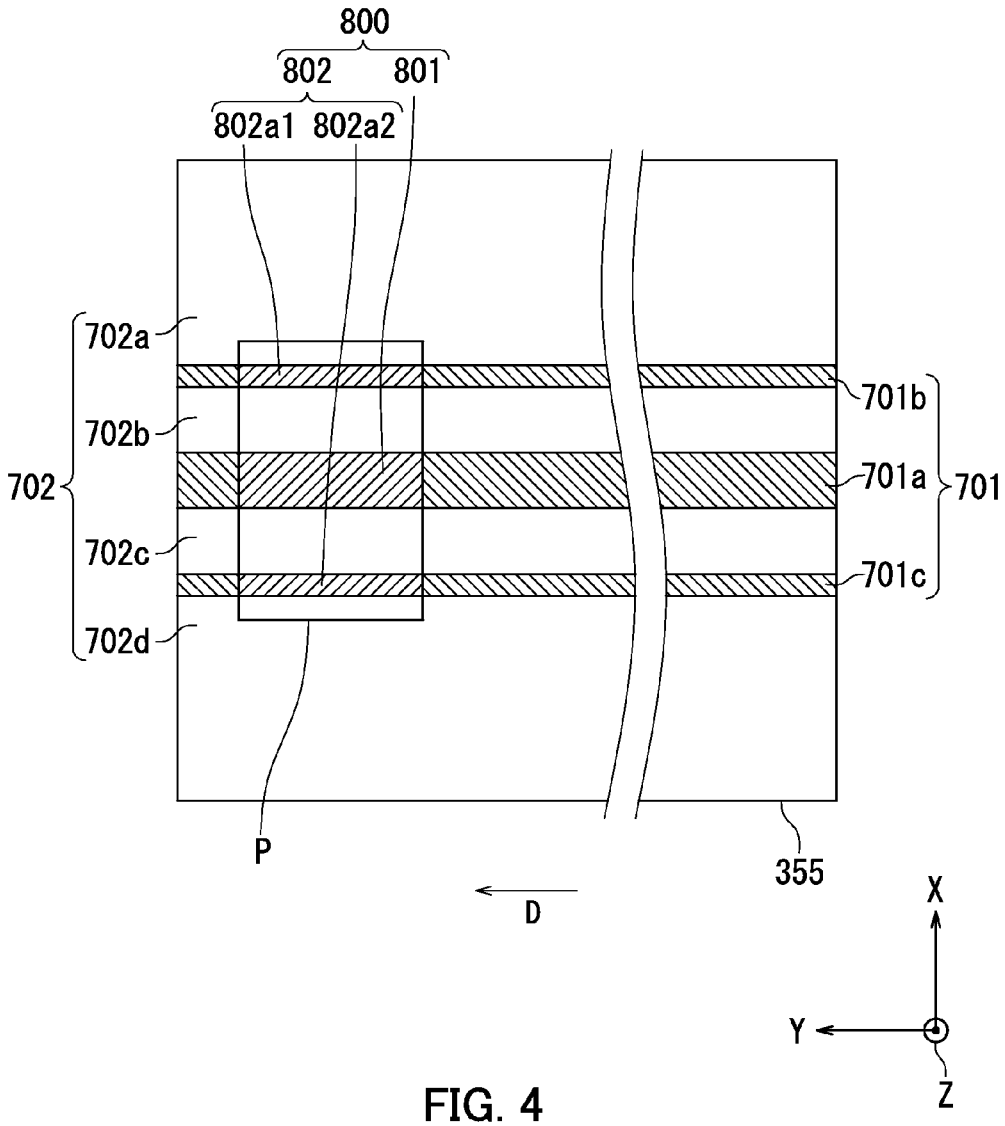
FIG. 4 is a plan view illustrating the conveyor belt according to a first embodiment of the present disclosure.

With reference to FIGS. 3A, 3B, and 4, description will be made below about the relationship between a region in the conveyance surface of the conveyor belt 355 and the contact region 800 in the recording medium P. FIG. 4 is a plan view illustrating the conveyor belt 355 according to the first embodiment of the present disclosure.

As illustrate in FIG. 4, the conveyor belt 355 includes a first region 701 and a second region 702. The first region 701 is a region of the conveyance surface of the conveyor belt 355 that is to overlap with the contact region 800 of the recording medium P in conveyance of the recording medium P placed on the conveyance surface of the conveyor belt 355. In other words, the first region 701 is a region of the conveyance surface of the conveyor belt 355 on which a part of the recording medium P to be placed. The first region 701 includes regions 701*a*, 701*b*, and 701*c*.

The region 701*a* is a region of the conveyance surface of the conveyor belt 355 that is to overlap with the contact region 801. The contact region 801 is a region of the recording medium P that is to come in contact with the roller member 312*a*, as described with reference to FIG. 3A.

The region 701*b* is a region of the conveyance surface of the conveyor belt 355 that is to overlap with the contact region 801*a*1. The contact region 802*a*1 is a region of the recording medium P that is to come in contact with the roller member 313*a*1, as described with reference to FIG. 3B.

The region 701*c* is a region of the conveyance surface of the conveyor belt 355 that is to overlap with the contact region 801*a*2. The contact region 802*a*2 is a region of the recording medium P that is to come in contact with the roller member 313*a*2, as described with reference to FIG. 3B. The first region 701 (regions 701*a*, 701*b*, and 701*c*) is a region of the conveyor belt 355 extending in terms of the conveyance direction D.

The second region 702 is adjacent to the first region 701. The second region 702 includes regions 702*a*, 702*b*, 702*c*, and 702*d*. The second region 702 (regions 702*a*, 702*b*, 702*c*, and 702*d*) is a region of the conveyor belt 355 extending in terms of the conveyance direction D.

Figure 5:
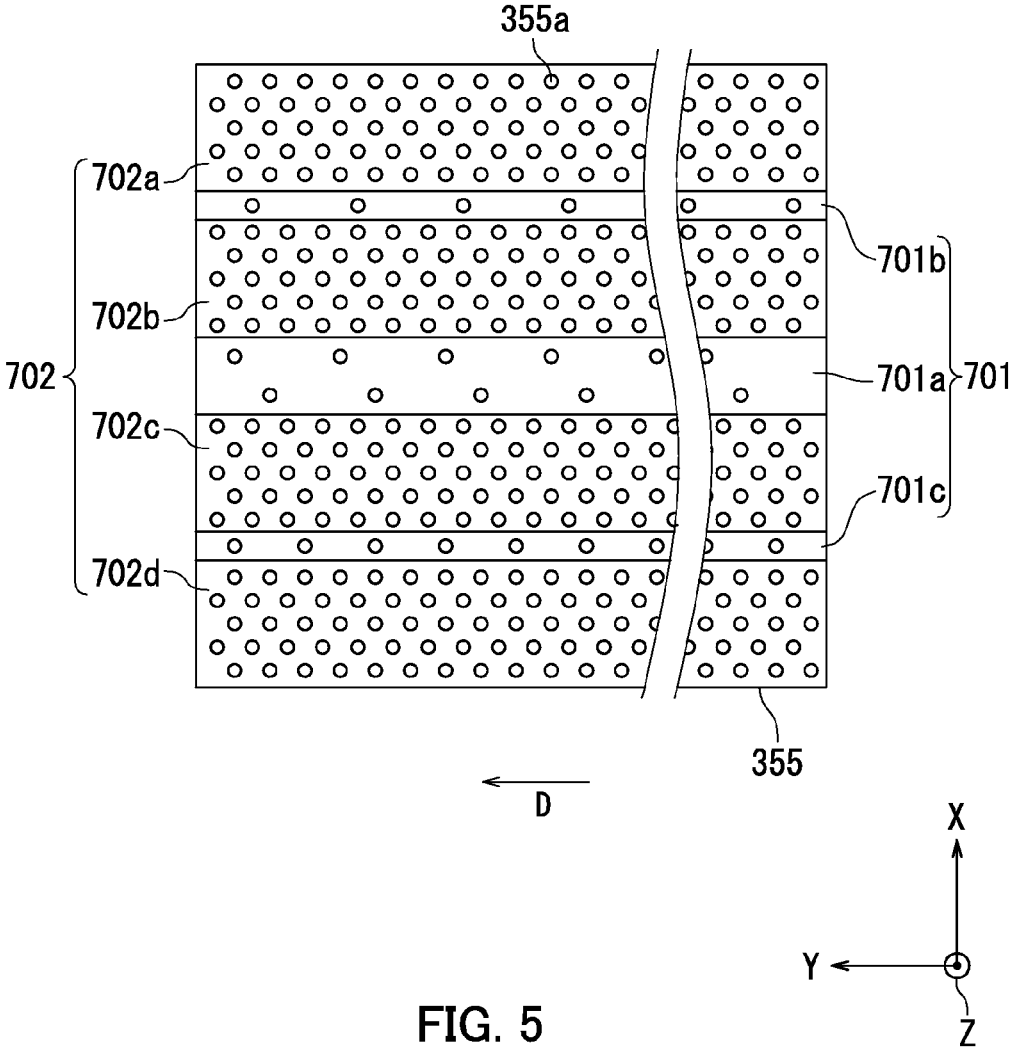
FIG. 5 is a plan view illustrating a conveyor belt according to a second embodiment of the present disclosure.

The conveyor belt 355 according to the first embodiment of the present disclosure will be described further in detail with reference to FIG. 5. FIG. 5 is a plan view illustrating the conveyor belt 355 according to the first embodiment of the present disclosure.

The suction holes 355*a* have an opening ratio in the first region 701 lower than in the second region 702, as illustrated in FIG. 5. Specifically, the ratio of the total area of the openings of the suction holes 355*a* in the first region 701 to the total area of the first region 701 is lower than the ratio of the total area of the openings of the suction holes 355*a* in the second region 702 to the total area of the second region 702.

An opening ratio R can be obtained by Equation 1 below.

$$R=St/S \quad \text{(Equation 1):}$$

wherein St is a total area of the openings of the suction holes 355*a* in a specific region, and S is a total area of the specific region. The opening ratio R is a ratio of the total area of the openings of the suction holes 355*a* in the specific region to the total area of the specific region.

In a configuration in which the diameters of the suction holes 355*a* are equal, St can be obtained by Equation 2 below.

$$St=Sa\times N \quad \text{(Equation 2):}$$

wherein Sa is an area of an opening of a suction hole 355*a* in a specific region, and N is the number of the suction holes 355*a* in the specific region. The total area of the openings of the suction holes 355*a* in the specific region is a total sum of the areas of the openings of the suction holes 355*a* in the specific region.

As described so far with reference to FIGS. 1-5, the opening ratio of the suction holes 355*a* in the first region 701 is lower than that of the suction holes 355*a* in the second region 702 in the conveyor belt 355. In the configuration as above, the negative pressure created by the suction section 360 can be reduced in the first region 701, thereby reducing air flow. In turn, paper dust can be prevented from separating from the recording medium P, being stirred up in air, and being attached to the nozzles.

[Second Embodiment]

Figure 6:
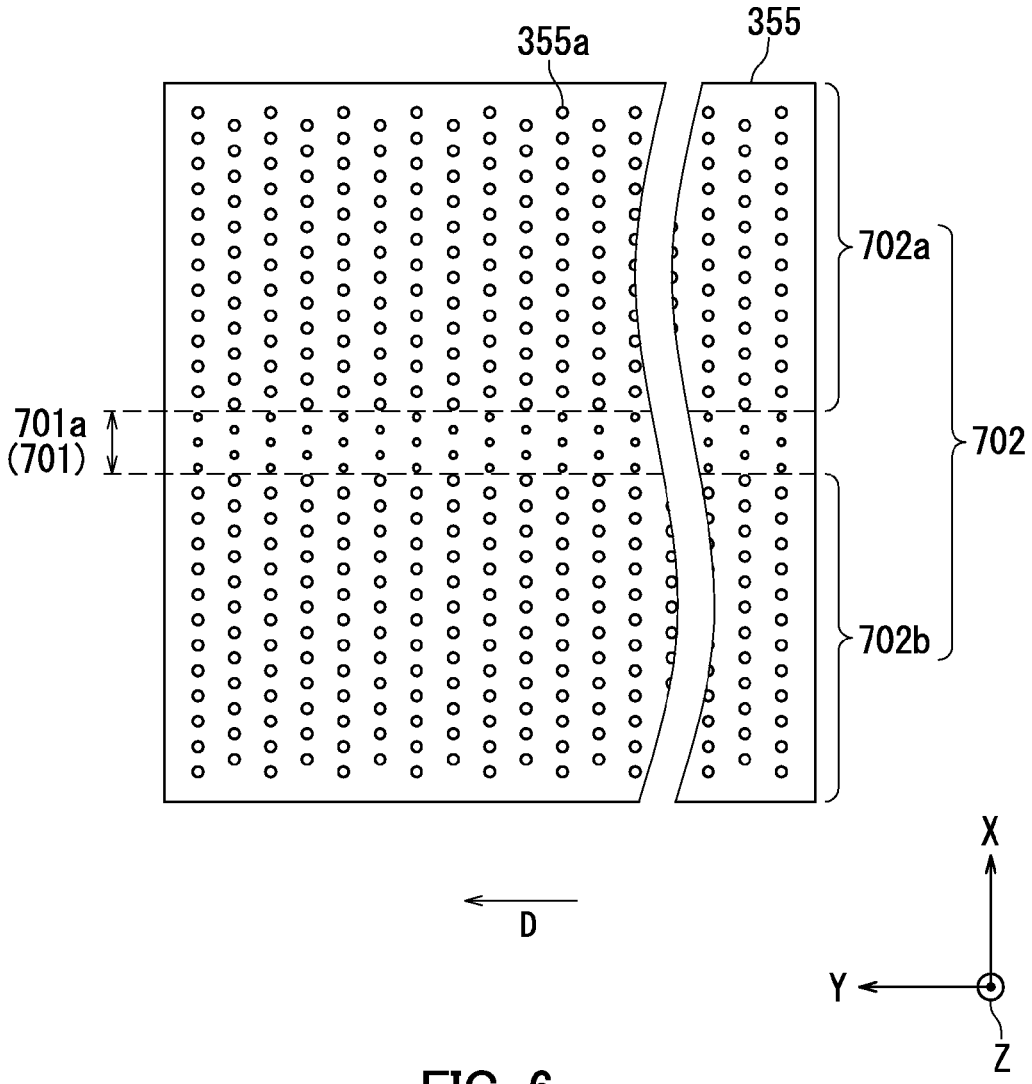
FIG. 6 is a plan view illustrating a conveyor belt according to the second embodiment of the present disclosure.
Figure 7A:
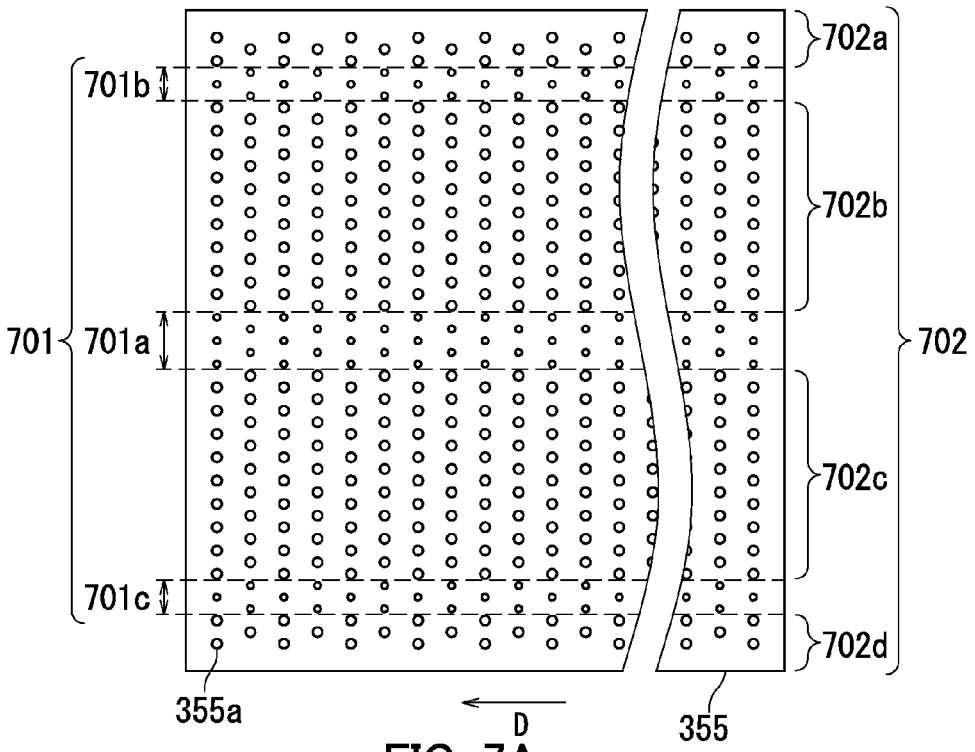
FIGS. 7A and 7B are plan views illustrating respective conveyor belts according to the second embodiment of the present disclosure.
Figure 7B:
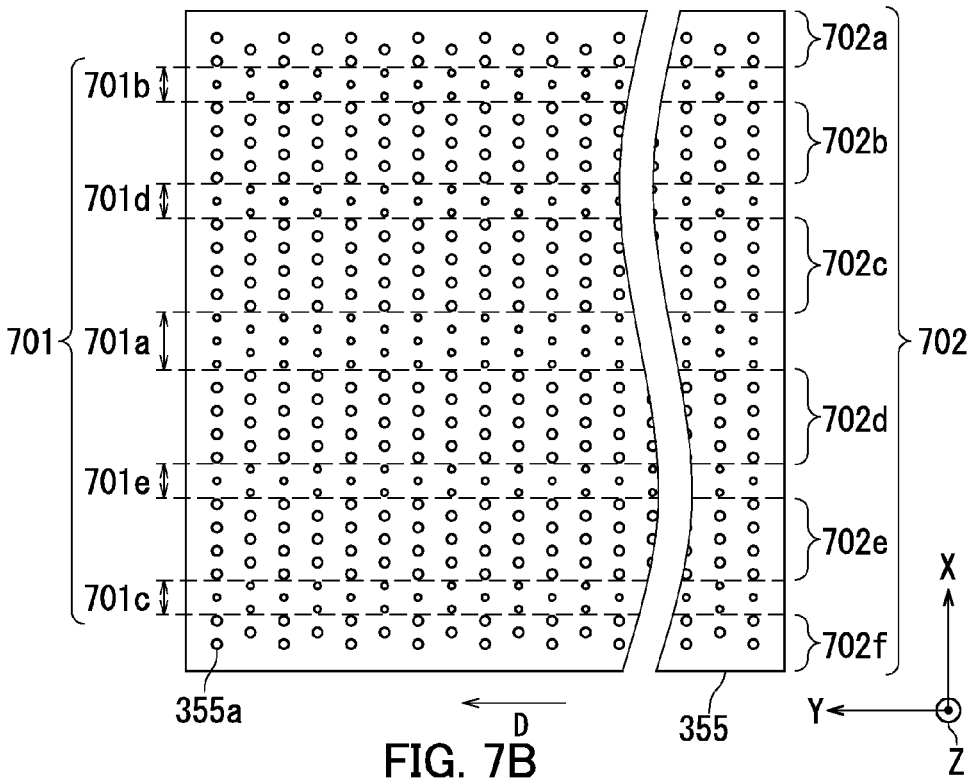

With reference to FIGS. 6, 7A. and 7B, conveyor belts 355 according to a second embodiment of the present disclosure will be described next. FIGS. 6, 7A, and 7B are plan views illustrating the respective conveyor belts 355 according to the second embodiment of the present disclosure.

FIG. 6 illustrates a conveyor belt 355 in a configuration in which a part of the recording medium P comes in contact with the paper feed roller 312. FIG. 7A illustrates a conveyor belt 355 in a configuration in which respective parts of the recording medium P come in contact with the paper feed roller 312 and the feed roller 313*a* that includes two roller members. FIG. 7B illustrates a conveyor belt 355 in a configuration in which respective parts of the recording medium P come in contact with the paper feed roller 312 and a feed roller 313*a* including four roller members.

The conveyor belts 355 illustrated in FIGS. 6, 7A, and 7B will be described first. The conveyor belt 355 illustrated in FIG. 6 includes a first region 701 (region 701*a*) and a second region 702 (regions 702*a* and 702*b*). The conveyor belt 355 illustrated in FIG. 7A includes a first region 701 (regions 701*a*, 701*b*, and 701*c*) and a second region 702 (region 702*a*, 702*b*, 702*c*, and 702*d*). The conveyor belt 355 illustrated in FIG. 7B includes a first region 701 (regions 701*a*, 701*b*, 701*c*, 701*d*, and 701*e*) and a second region 702 (regions 702*a*, 702*b*, 702*c*, 702*d*, 702*e*, and 702*f*).

As illustrated in FIGS. 6, 7A, and 7B, the suction holes 355*a* in the first region 701 each have a diameter smaller than those in the second region 702 in each of the conveyor belts 355. In other words, among the suction holes 355*a*, the opening area of each of the suction holes 355*a* (area of an opening of a suction hole) in the first region 701 is smaller than that of each of the suction holes 335*a* in the second region 702.

In the present embodiment, each of the suction holes 355*a* in the first region 701 has a diameter of 1.5 mm. Also, the suction holes 355*a* in the second region 702 each have a diameter of 2 mm. Distances in the X and Y directions between adjacent suction holes 355*a* in both the first and second regions 701 and 702 are 8 mm and 8 mm, respectively. The suction holes 355*a* in the first and second regions 701 and 702 are arranged in a staggered formation in the X and Y directions indicated in each of the drawings.

As described with reference to FIGS. 6, 7A, and 7B, the opening area of each of the suction holes 355*a* in the first region 701 is smaller than that of each of the suction holes 355*a* in the second region 702 in each of the conveyor belts 355. In each of the configurations as above, the negative pressure generated by the suction section 360 can be reduced in the first region 701. As a result, paper dust can be prevented from being stirred up in air and attached to the nozzles while degradation in image quality can be reduced that may be caused due to flexure of the recording medium P or lift up of the recording medium from the conveyor belt 355.

[Third Embodiment]

Figure 8:
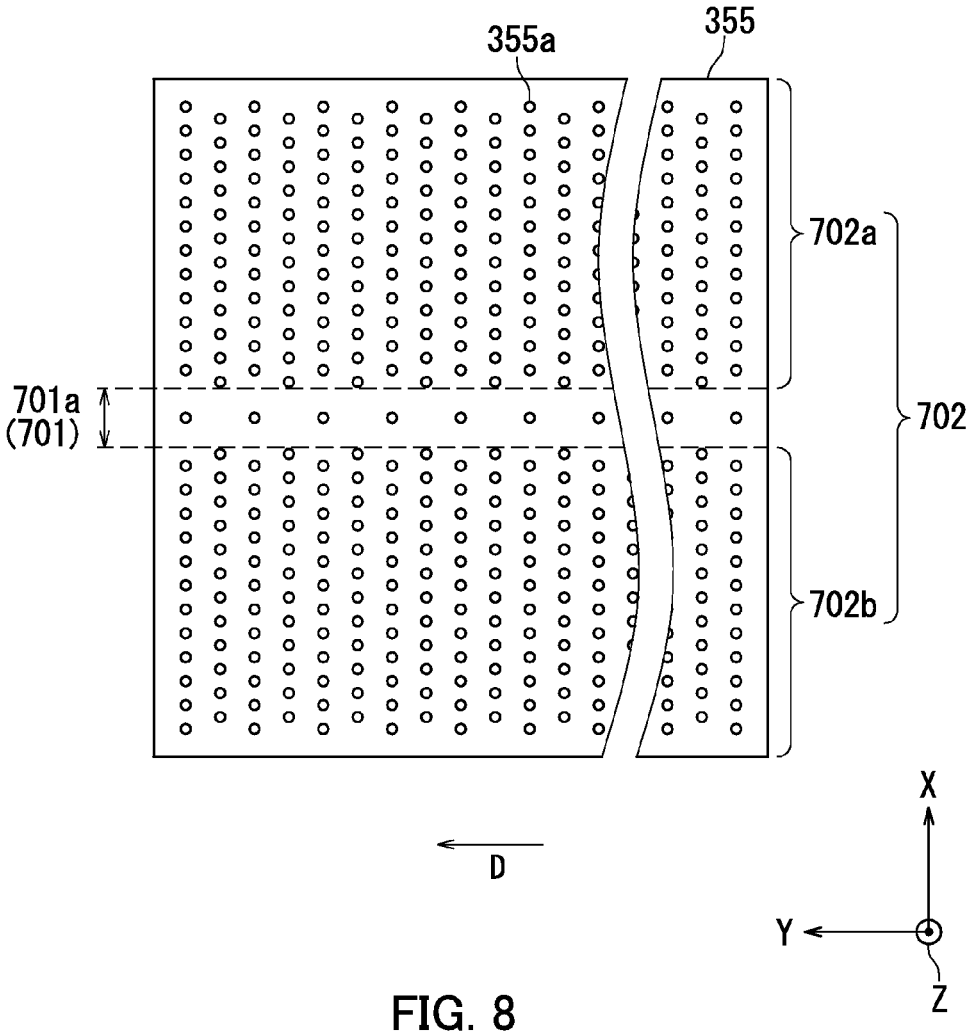
FIG. 8 is a plan view illustrating a conveyor belt according to a third embodiment of the present disclosure.
Figure 9A:
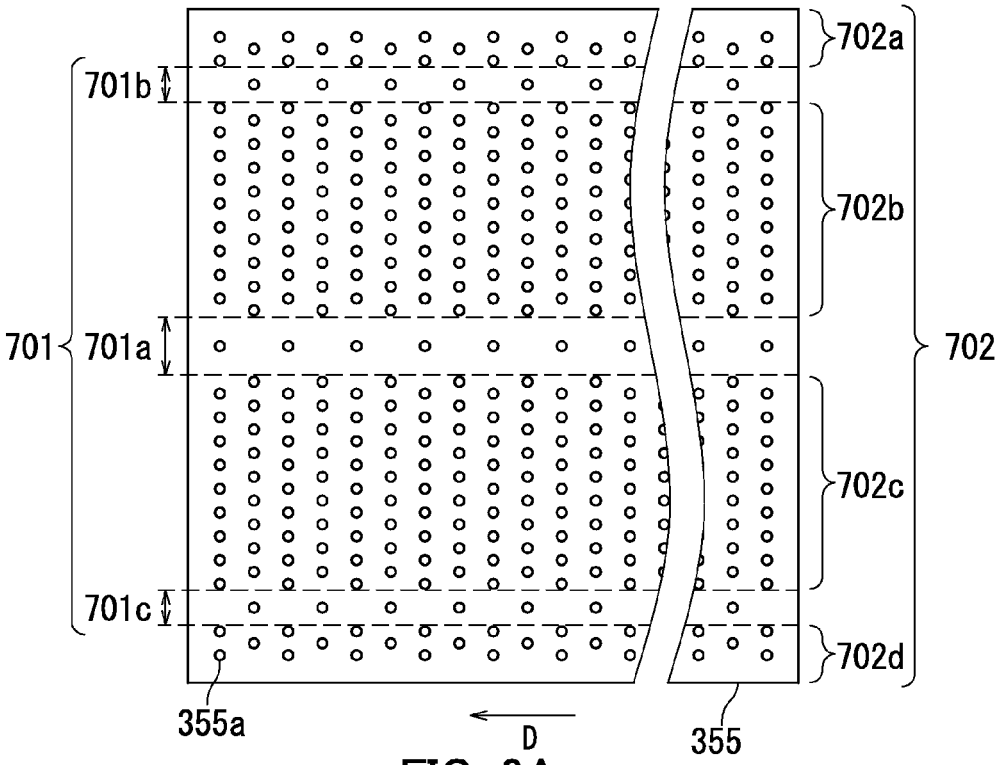
FIGS. 9A and 9B are plan views illustrating respective conveyor belts according to the third embodiment of the present disclosure.
Figure 9B:
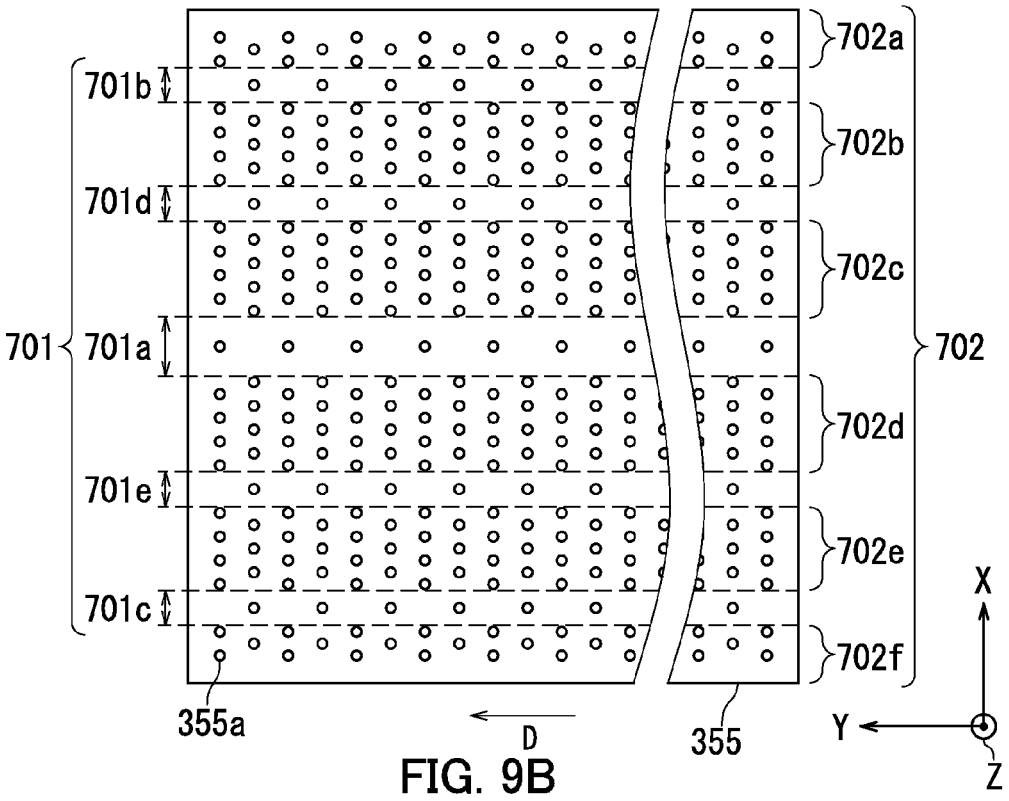

With reference to FIGS. 8, 9A, and 9B, conveyor belts 355 according to a third embodiment of the present disclosure will be described next. FIGS. 8, 9A, and 9B are plan views illustrating the respective conveyor belts 355 according to the third embodiment of the present disclosure.

FIG. 8 illustrates a conveyor belt 355 in a configuration in which a part of the recording medium P comes in contact with the paper feed roller 312. FIG. 9A illustrates a conveyor belt 355 in a configuration in which respective parts of the recording medium P come in contact with the paper feed roller 312 and the feed roller 313*a* including two roller members. FIG. 9B illustrates a conveyor belt 355 in a configuration in which respective parts of the recording medium P come in contact with the paper feed roller 312 and the feed roller 313*a* including four roller members.

The regions in the conveyor belts 355 illustrated in FIGS. 8, 9A, and 9B are the same as those illustrated in FIGS. 6, 7A, and 7B. Therefore, description thereof is omitted.

As illustrated in FIGS. 8, 9A, and 9B, distance between adjacent suction holes 355*a* in the first region 701 is wider than that between adjacent suction holes 355*a* in the second region 702 in each of the conveyor belts 355. In other words, the number of the suction holes 355*a* per unit area in the first region 701 is smaller than that of the suction holes 355*a* per unit area in the second region 702. In the present embodiment, the distances in the X and Y directions between adjacent suction holes 355*a* in the first region 701 are 8 mm and 16 mm, respectively. By contrast, the distances in the X and Y directions between adjacent suction holes 355*a* in the second region 702 are 8 mm and 8 mm, respectively. The diameter of each of the suction holes 355*a* in the first and second regions 701 and 702 is 2 mm. The suction holes 355*a* in the first and second regions 701 and 702 are arranged in a staggered formation in the X and Y directions in each of the conveyor belts 355.

As described with reference to FIGS. 8, 9A, and 9B, the number of the suction holes 355*a* per unit area in the first region 701 is smaller than that of the suction holes 335*a* per unit area in the second region 702 in each of the conveyor belts 355. In each of the configurations as above, the negative pressure generated by the suction section 360 can be reduced in the first region 701. As a result, paper dust can be prevented from being stirred up in air and being attached to the nozzles while degradation in image quality can be reduced that may be caused due to flexure of the recording medium P or lift up of the recording medium P from the conveyor belt 355.

[Fourth Embodiment]

Figure 10:
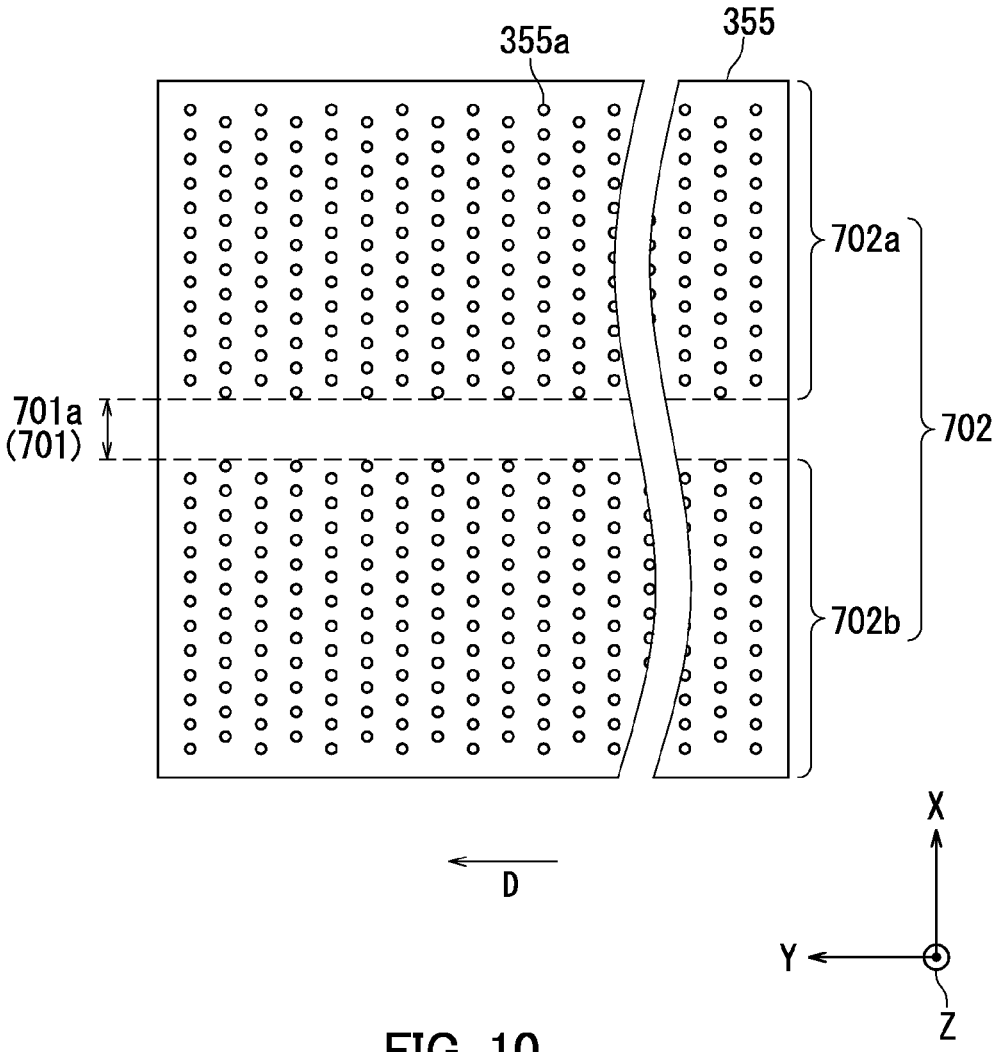
FIG. 10 is a plan view illustrating a conveyor belt according to a fourth embodiment of the present disclosure.
Figure 11A:
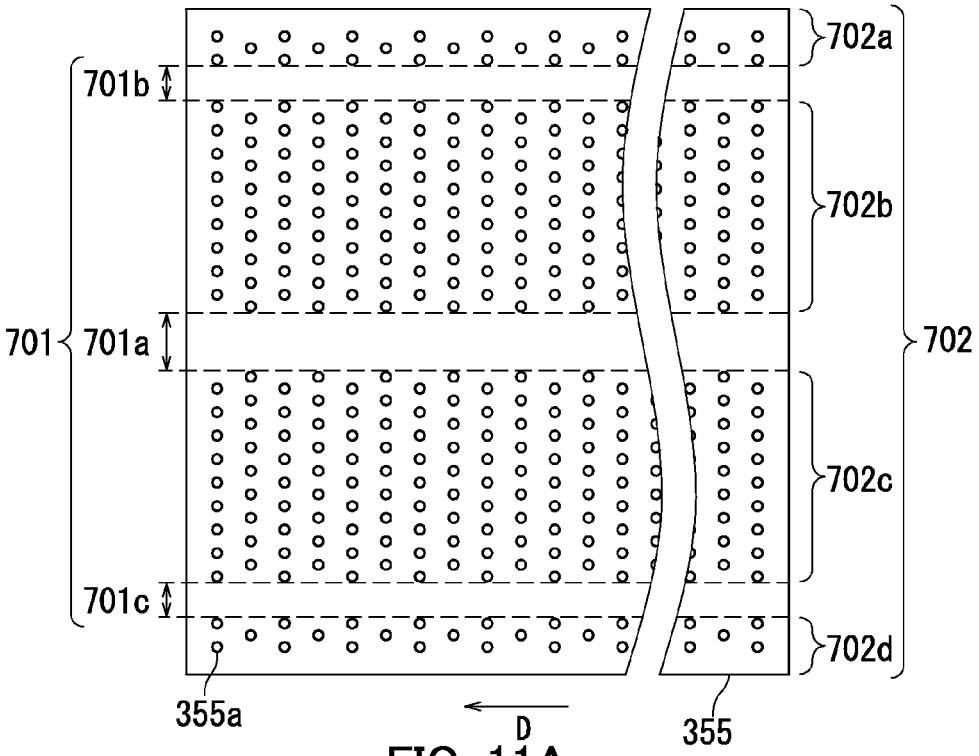
FIGS. 11A and 11B are plan views illustrating respective conveyor belts according to the fourth embodiment of the present disclosure.
Figure 11B:
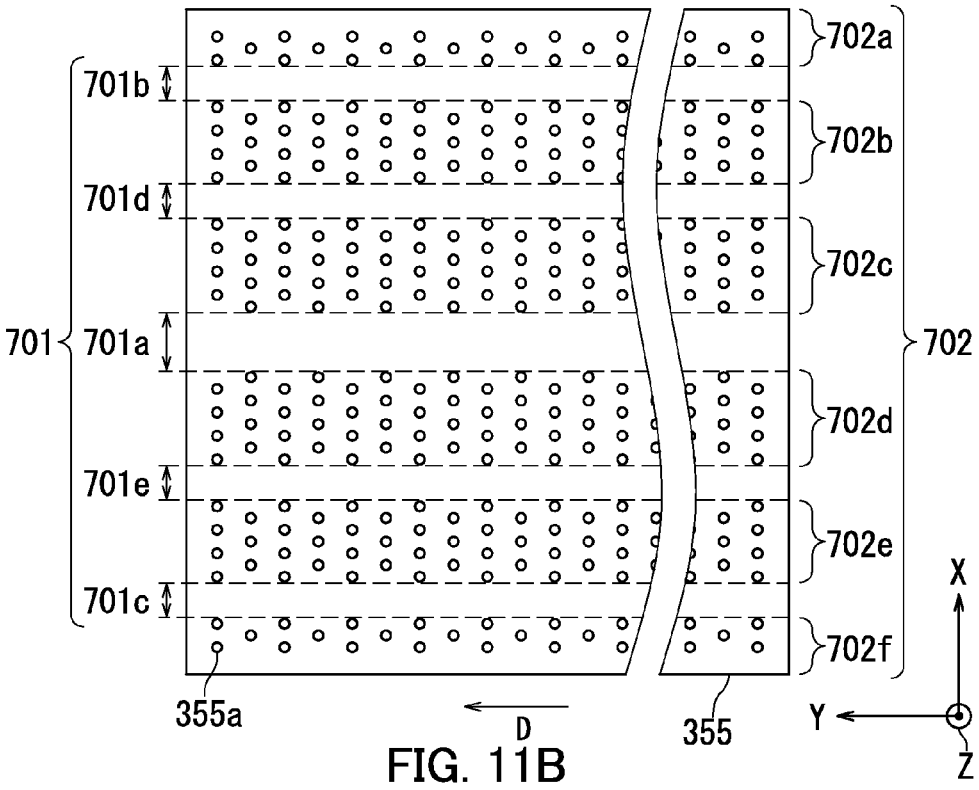

With reference to FIGS. 10, 11A, and 11B, conveyor belts 355 according to a fourth embodiment of the present disclosure will be described next. FIGS. 10, 11A, and 11B are plan views illustrating the respective conveyor belts 355 according to the fourth embodiment of the present disclosure.

FIG. 10 illustrates a conveyor belt 355 in a configuration in which a part of the recording medium P comes in contact with the paper feed roller 312. FIG. 11A illustrates a conveyor belt 355 in a configuration in which respective parts of the recording medium P come in contact with the paper feed roller 312 and the feed roller 313*a* including two roller members. FIG. 11B illustrates a conveyor belt 355 in a configuration in which respective parts of the recording medium P come in contact with the paper feed roller 312 and the feed roller 313*a* including four roller members.

The regions in the conveyor belts 355 illustrated in FIGS. 10, 11A, and 11B are the same as those illustrated in FIGS. 6, 7A, and 7B, and therefore, description thereof is omitted.

As illustrated in FIGS. 10, 11A, and 11B, the first region 701 has no suction holes 355*a* in each of the conveyor belts 355. In the present embodiment, the suction holes 355*a* in the second region 702 each have a diameter of 2 mm in each of the conveyor belts 355. Distances in the X and Y directions between adjacent suction holes 355*a* in the second region 702 are 8 mm and 8 mm, respectively. The suction holes 355*a* in the second region 702 are arranged in a staggered formation in the X and Y directions of each of the conveyor belts 355.

As described with reference to FIGS. 10, 11A, and 11B, the first region 701 has no suction holes 355*a* in each of the conveyor belt 355. In each of the configurations as above, no negative pressure generated by the suction section 360 is present in the first region 701, thereby enabling significant reduction in air flow. In turn, paper dust can be prevented from separating and being stirred up from the recording medium p and being attached to the nozzles.

[Fifth Embodiment]

Figure 12A:
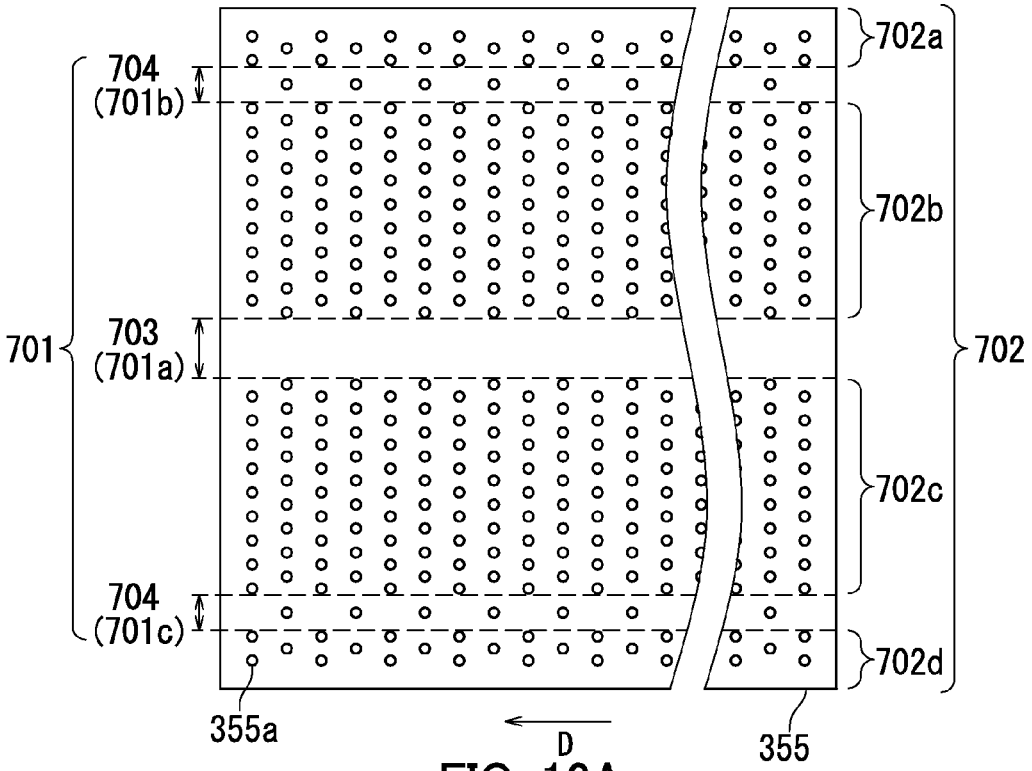
FIGS. 12A and 12B are plan views illustrating respective conveyor belts according to a fifth embodiment of the present disclosure.
Figure 12B:
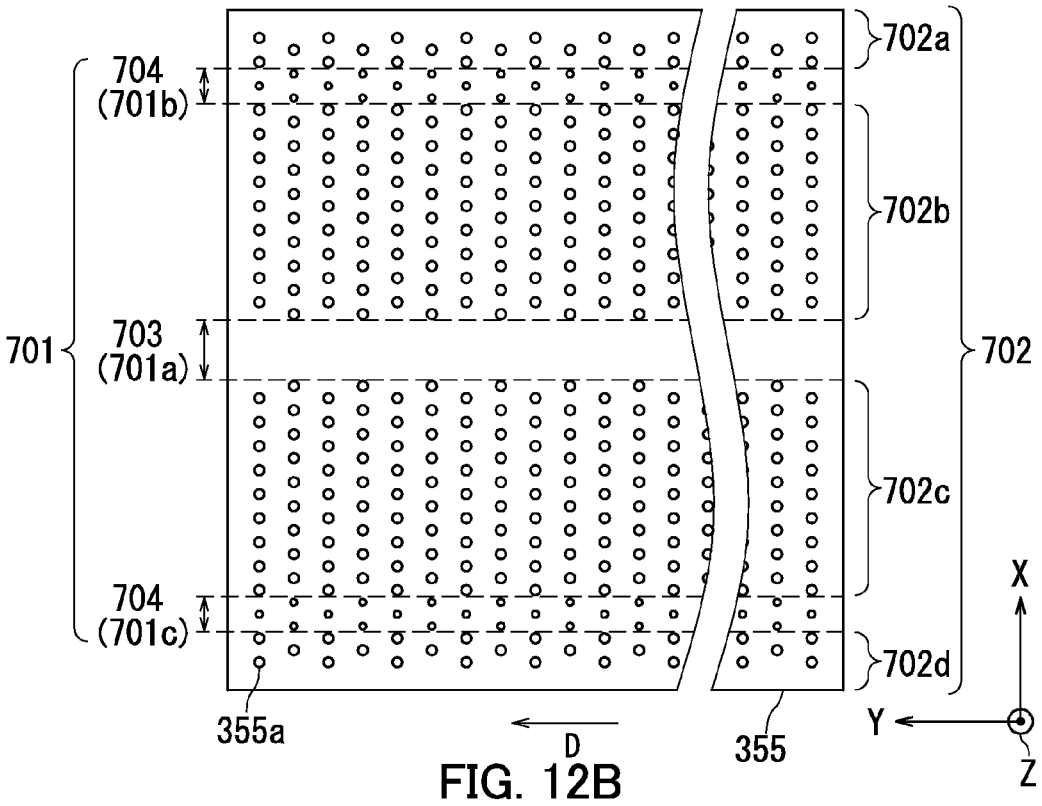

With reference to FIGS. 12A and 12B, conveyor belts 355 according to a fifth embodiment of the present disclosure will be described next. FIGS. 12A and 12B are plan views illustrating the respective conveyor belts 355 according to the fifth embodiment of the present disclosure.

FIGS. 12A and 12B illustrate the respective conveyor belts 355 each having a configuration in which respective parts of the recording medium P come in contact with the paper feed roller 312 and the feed roller 313*a* including two roller members.

Each of the conveyor belts 355 illustrated in FIGS. 12A and 12B includes a first region 701 (regions 701*a*, 701*b*, and 701*c*) and a second region 702 (regions 702*a*, 702*b*, 702*c*, and 702*d*). Specifically, the first region 701 includes a third region 703 corresponding to the region 701*a* and a fourth region 704 corresponding to the regions 701*b* and 701*c*.

As described with reference to FIGS. 3A and 4, the third region 703 is a region of the conveyor belt 355 that is to receive a part (contact region 801) of the recording medium P that has come in contact with the roller member 321*a*.

As described with reference to FIGS. 3B and 4, the fourth region 704 is a region of the conveyor belt 355 that is to receive a part (contact region 802) of the recording medium P that has come in contact with the roller members 313*a*1 and 313*a*2.

The third region 703 has no suction holes 355*a* in the conveyor belt 355 illustrated in FIG. 12A. Distance between adjacent suction holes 355*a* in the fourth region 704 is wider than that between adjacent suction holes 355*a* in the second region 702. In other words, the number of the suction holes 355*a* per unit area in the fourth region 704 is smaller than that of the suction holes 355*a* per unit area in the second region 702. In the conveyor belt 355 illustrated in FIG. 12A, the distances in the X and Y directions between adjacent suction holes 355*a* in the fourth region 704 are 8 mm and 16 mm, respectively. The distances in the X and Y directions between adjacent suction holes 355*a* in the second region 702 are 8 mm and 8 mm, respectively. The diameter of each of the suction holes 355*a* in the second and fourth regions 702 and 704 is 2 mm The suction holes 355*a* in the second and fourth regions 702 and 704 are arranged in a staggered formation in the X and Y directions.

The third region 703 has no suction holes 355*a* in the conveyor belt 355 illustrated in FIG. 12B. The suction holes 355*a* in the fourth region 704 each have a diameter smaller than those in the second region 702. The suction holes 355*a* in the fourth region 704 each have a diameter of 1 mm in the conveyor belt 355 illustrated in FIG. 12B. The suction holes 355*a* in the second region 702 each have a diameter of 2 mm. Distances in the X and Y directions between adjacent suction holes 355*a* in both the second and fourth regions 702 and 704 are 8 mm and 8 mm, respectively. The suction holes 355*a* are arranged in a staggered formation in the X and Y direction of the conveyor belt 355 in the second and fourth regions.

As described with reference to FIGS. 12A and 12B, the third region 703 has no suction holes 355*a* and the opening ratio of the suction holes 355*a* in the fourth region 704 is lower than that of the suction holes 335*a* in the second region 702 in each of the conveyor belts 355. In each of the configurations as above, no negative pressure generated by the suction section 360 is present in the third region 703, in which paper dust may be significantly produced, thereby enabling significant reduction in air flow. Further, the negative pressure generated by the suction section 360 can be reduce in the fourth region 704, thereby enabling reduction in air flow in the fourth region 704. As a result, paper dust can be prevented from separating and being stirred up in air from the recording medium P and being attached to the nozzles while degradation in image quality can be reduced that may be caused due to flexure of the recording medium P or lift up of the recording medium P from the conveyor belt 355.

[Sixth Embodiment]

Each of the conveyor belts 355 described with reference to FIGS. 1-9 has the suction holes 355*a* located all over the conveyor belt 355. However, the suction holes 355*a* may not be located all over the conveyor belt 355 so long as the opening ratio of the suction holes 355*a* in the first region 701 is lower than that of the suction holes 355*a* in the second region 702. For example, the suction holes 355*a* may not be located in a part or entirety of an end portion in the X direction of the conveyor belt 355.

Figure 13:
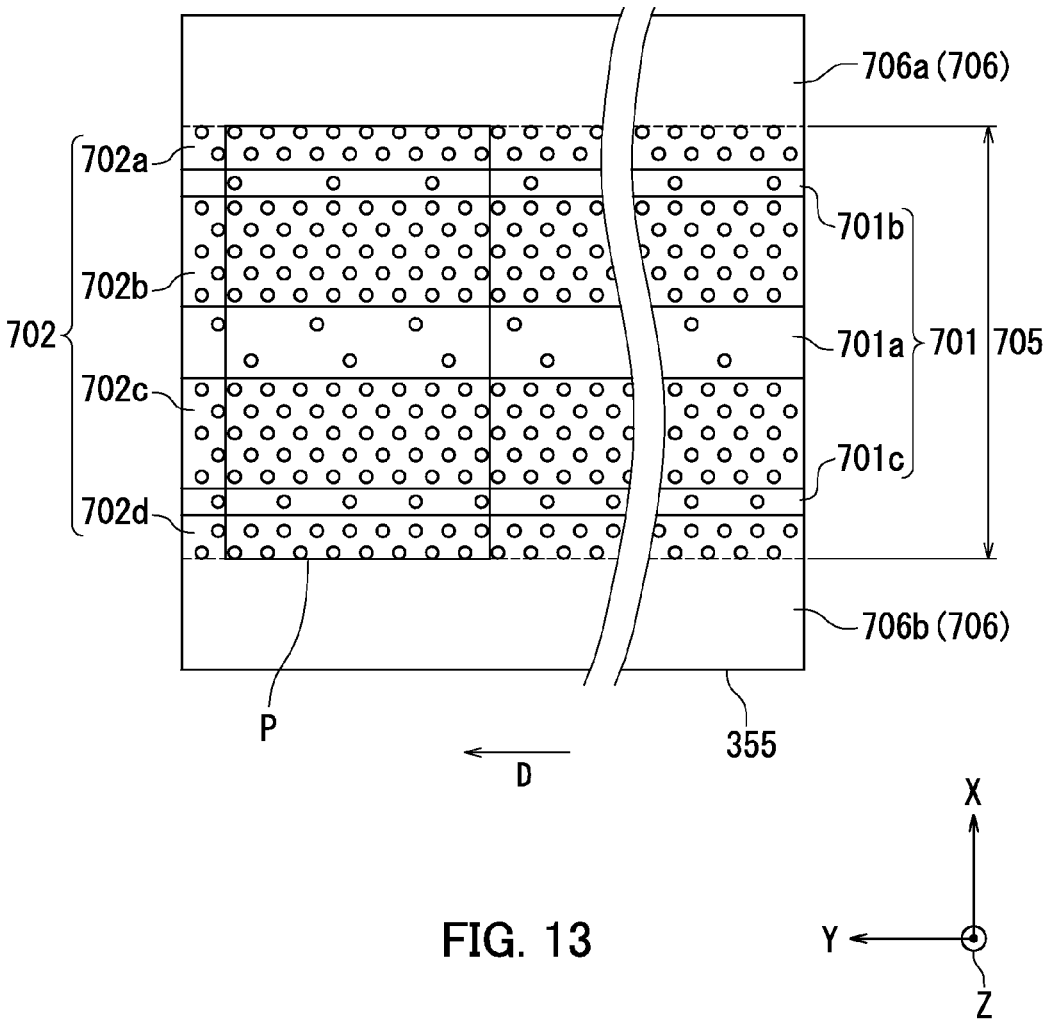
FIG. 13 is a plan view illustrating a conveyor belt according to a sixth embodiment of the present disclosure.

A conveyor belt 355 according to a sixth embodiment of the present disclosure will be described with reference to FIGS. 13. FIG. 13 is a plan view illustrating the conveyor belt 355 according to the sixth embodiment of the present disclosure.

The conveyor belt 355 includes a recording medium loading region 705 and a recording medium non-loading region 706. The recording medium loading region 705 is a region of the conveyance surface of the conveyor belt 355 that is to receive a recording medium P. The recording medium loading region 705 includes a first region 701 and a second region 702. The recording medium non-loading region 706 is adjacent to the recording medium loading region 705. The recording medium non-loading region 706 includes a region 706*a* and a region 706*b*.

The respective regions 706*a* and 706*b* are located on the respective opposite end portions in the X direction of the conveyor belt 355. The suction holes 355*a* may not be located in a part or entirety of the regions 706*a* and 706*b*.

Similarly to the conveyor belts 355 described with reference to FIGS. 1-12B, the opening ratio of the suction holes 355*a* in the first region 701 is lower than that of the suction holes 355*a* in the second region 702 in the recording medium loading region 705 of the conveyor belt 355 in the present embodiment. In the configuration as above, the negative pressure generated by the suction section 360 can be reduce in the first region 701, thereby enabling reduction in air flow. As a result, paper dust can be prevented from separating and being stirred up in air from the recording medium P and being attached to the nozzles.

So far, the embodiments of the present disclosure have been described with reference to the drawings (FIGS. 1-13). However, the present disclosure is not limited to the above embodiments and can be practiced in various ways within the scope not departing from the gist of the present disclosure. The drawings are schematic illustrations that emphasize elements of configuration in order to facilitate understanding thereof. Therefore, in order that the elements can be easily illustrated in the drawings, properties of each of the elements, such as thickness, length, and number thereof, may differ from actual properties of the element. Also note that material properties, shapes, dimensions, and the like, described for each of the elements of configuration in the following embodiments, are only examples and are not intended to impose any particular limitations on the elements. Various alternations can be made thereto within the scope not substantially departing from the effect of the present disclosure.

For example, the present disclosure is applicable to any combinations of two or more of the second to fourth embodiments. Specifically, in the present disclosure, the opening area of each of the suction holes 355*a* in a part of the first region 701 may be smaller than that of each of the suction holes 355*a* in the second region 702 (second embodiment) and the number of the suction holes 355*a* per unit area in a part of the first region 701 may be smaller than that of the suction holes 355*a* per unit area in the second region 702 (third embodiment).

Note that the suction holes 355*a* in the conveyor belt 355 are arranged in a staggered formation in the above embodiments but may be in a lattice pattern.

Further, the conveyor belt 355 has an endless shape in the above embodiments but may have a linear shape.

Any other variety of alterations may be made to the above embodiments within the scope not deviating from the subject matter of the present disclosure.

What is claimed is:

1. A conveyor device comprising:

at least one roller that has a width narrower than a width of a recording medium in a direction perpendicular to a conveyance direction of the recording medium and that feeds the recording medium while in contact with a part of the recording medium;

a conveyor belt that circulates to convey the recording medium having been fed by the at least one roller; and a suction section that sucks the recording medium onto the conveyor belt, wherein the conveyor belt includes a first region and a second region adjacent to each other in the direction perpendicular to the conveyance direction of the recording medium, the first region extends in a direction in which the conveyor belt circulates and is to receive the part of the recording medium in contact with the at least one roller, the second region extends in the direction in which the conveyor belt circulates and is to receive a part of the recording medium out of contact with the at least one roller, the conveyor belt has a plurality of suction holes in communication with the suction section, the suction holes have a lower opening ratio in the first region than in the second region, the opening ratio of the suction holes in the first region is an opening area per unit area of the suction holes in the first region, and the opening ratio of the suction holes in the second region is an opening area per unit area of the suction holes in the second region.

2. The conveyor device according to claim 1, wherein an opening area of each of the suction holes in the first region is smaller than that of each of the suction holes in the second region.

3. The conveyor device according to claim 1, wherein the number of the suction holes per unit area in the first region is smaller than that of the suction holes per unit area in the second region.

4. The conveyor device according to claim 1, wherein the first region of the conveyor belt has no suction hole.

5. The conveyor device according to claim 1, wherein the at least one roller includes a paper feed roller.

6. The conveyor device according to claim 5, wherein the at least one roller includes a conveyance roller.

7. The conveyor device according to claim 6, wherein the first region of the conveyor belt includes a third region and a fourth region, the third region is a region that is to receive a part of the recording medium that has come in contact with the paper feed roller, the fourth region is a region that is to receive another part of the recording medium that has come in contact with the conveyance roller, the third region has no suction hole, and an opening ratio of suction holes in the fourth region among the plurality of suction holes is lower than that of suction holes in the second region among the plurality of suction holes.

8. The conveyor device according to claim 1, wherein the first and second regions of the conveyor belt are each included in a region of the conveyor belt that is to receive the recording medium.

9. An inkjet recording apparatus comprising:

the conveyor device according to claim 1; and an inkjet head located opposite to the conveyor device.

* * * * *